United States Patent [19]

DeCoster

[11] 4,077,757

[45] Mar. 7, 1978

[54] CONCRETE PANEL MAKING APPARATUS

[76] Inventor: James W. DeCoster, 137 James St., Green Bay, Wis. 54303

[21] Appl. No.: 781,951

[22] Filed: Mar. 28, 1977

[51] Int. Cl.[2] ..... B28B 11/22

[52] U.S. Cl. ..... 425/218; 249/172; 425/258; 425/454; 249/137

[58] Field of Search ..... 425/88, 62, 64, 218, 425/219, 256, 258, 454; 249/1, 137, 171, 170, 172, 18

[56] References Cited

U.S. PATENT DOCUMENTS

| | | | |
|---|---|---|---|
| 836,277 | 11/1906 | Perjue | 249/137 |
| 1,023,349 | 4/1912 | Aiken | 249/137 X |
| 2,492,171 | 12/1949 | Miller | 425/454 |
| 2,596,052 | 5/1952 | Stockman | 425/454 X |
| 3,003,188 | 10/1961 | Weiss | 249/137 X |
| 3,328,859 | 7/1967 | Stevens | 425/454 |
| 3,640,658 | 2/1972 | Price | 249/137 X |
| 3,647,308 | 3/1972 | Yost | 425/219 X |
| 3,659,986 | 5/1972 | Gelbman | 425/88 |
| 3,775,529 | 11/1973 | Steenson et al. | 425/218 X |
| 3,931,951 | 1/1976 | Fougea | 249/172 X |

*Primary Examiner*—J. Howard Flint, Jr.
*Attorney, Agent, or Firm*—Holden, Recka and Kozak

[57] ABSTRACT

Apparatus for horizontally casting a panel, preferably a non-composite insulated panel of reinforced concrete of substantial area and thickness in a heated mold. The mold is part of a rotating mechanism and lift frame for rotating and vertically stacking the panel when the panel is partially cured.

Reinforcing steel is put into a heated mold. A layer of concrete is poured into the mold, forced into close and intimate contact with the mold and through the reinforcing steel by means of a traveling auger, striker plate and vibrating screed; insulation board and shear connectors are placed in the mold, further reinforcing steel is then placed in the mold, and a second layer of concrete is poured into the mold and forced through the reinforcing steel, by means of the traveling auger, striking plate and vibrating screed, which at the same time as they force the concrete through the steel, produce a smooth finish on the non-mold contacting surface of the concrete panel.

The mold can be heated by means of heating tubes attached to the bottom outside surface of the mold.

When the panel has set, hydraulic cylinders pivot the mold with its contained panel on to supports and into a vertical position for stacking and storing the finished panel.

7 Claims, 9 Drawing Figures

CONCRETE PANEL MAKING APPARATUS

BACKGROUND OF INVENTION

This invention relates to building construction and to the art of casting and machine finishing, on the job site, thick non-composite insulated panels of reinforced concrete in a horizontal mold and then rotating the cast panels into a vertical position for curing and storage. The invention further relates to the manufacture of such panels having a decorative outside surfacing, such as a corrugated surface.

Insulated and reinforced panels of this type have been made in a factory setting in stationary molds. It has not been possible to make such panels on the job site. Factory made panels, after being poured and cured in a horizontal mold, are stripped from the mold and then are trucked from the factory production site to the job site.

A method of making thick panels on the job site, though not for making non-composite insulated panels, is on-site tip-up construction. In this method concrete panels are cast on a concrete floor, using the floor as the bottom of the mold and using a framework of four sides as the sides of the mold. When the cast panels produced by this method are cured, they are rotated into a vertical position by means of a crane.

BRIEF SUMMARY OF INVENTION

It is a primary object of this invention to produce, on the job site, non-composite insulated load bearing concrete wall panels, which can have various decorative faces, and to be able to do this during any phase of construction and under adverse weather conditions at all times of the year.

It is an object of this invention to produce the insulated wall panel on the job site so materials purchased at the job site can be used, thereby effecting a substantial saving in transportation cost over the cost of moving a completed panel from a factory, and further to reduce the amount of steel needed in the reinforced panel by eliminating that reinforcing steel added to such a panel solely to cope with the racking stress incident to transportation and further to eliminate the surface cracking incident to transportation of factory produced panels by producing panels on a job site.

It is a further object of this invention to produce a non-composite insulated panel that cannot be produced by the tip-up method of job site construction.

Normally an insulated concrete panel is of composite construction. That is, there is an integral concrete connection between the inner and outer layers of concrete with a partial layer of insulation sandwiched within the layers. The concrete connection is needed to hold the concrete panel together. The concrete connection is a heat transmission section and a localized stress area. Both defects are eliminated in non-composite panels.

It is an object of the invention to make a portable apparatus for making the panel that can be used on an unprepared and often soft and muddy job site. The device, though portable, must be able to withstand the stresses incident to casting and rotating a heavy concrete panel.

Further, it is an object of the invention to eliminate that portion of the reinforcing steel needed in such a panel to resist the flexing stress induced when such a panel is pivoted from a horizontal to a vertical position by not allowing said panel to flex during the raising from horizontal to vertical. The reinforcing steel added to the panel to resist the flexing stress is needed only at one time during the life of the panel, that is to resist the flexing incident to pivoting the panel from a horizontal to a vertical position.

The invention can be used to produce a panel of variable length and thickness containing a non-composite insulated section; a load bearing section with a machine finish surface and a decorative surface.

The invention can produce at least two finished concrete panels per day and can be used in winter and in inclement weather. The insulated concrete panels, when joined together edge to edge, form a concrete wall that is "continuous" in insulation through the length of the wall except for caulk joints between the panels. The insulated section can be of any thickness.

The mold used to cast the panels is rotatable in its longitudinal direction and a panel of length limited only by the length of the mold can be cast therein.

The apparatus further improves on conventional tilt-up construction because it can be used before a floor is cast, and the apparatus is not subject to the ground problems tilt-up construction is subject to in cold weather. Many decorative faces are available on the panels and panels can be cast before construction begins.

Figure 1:
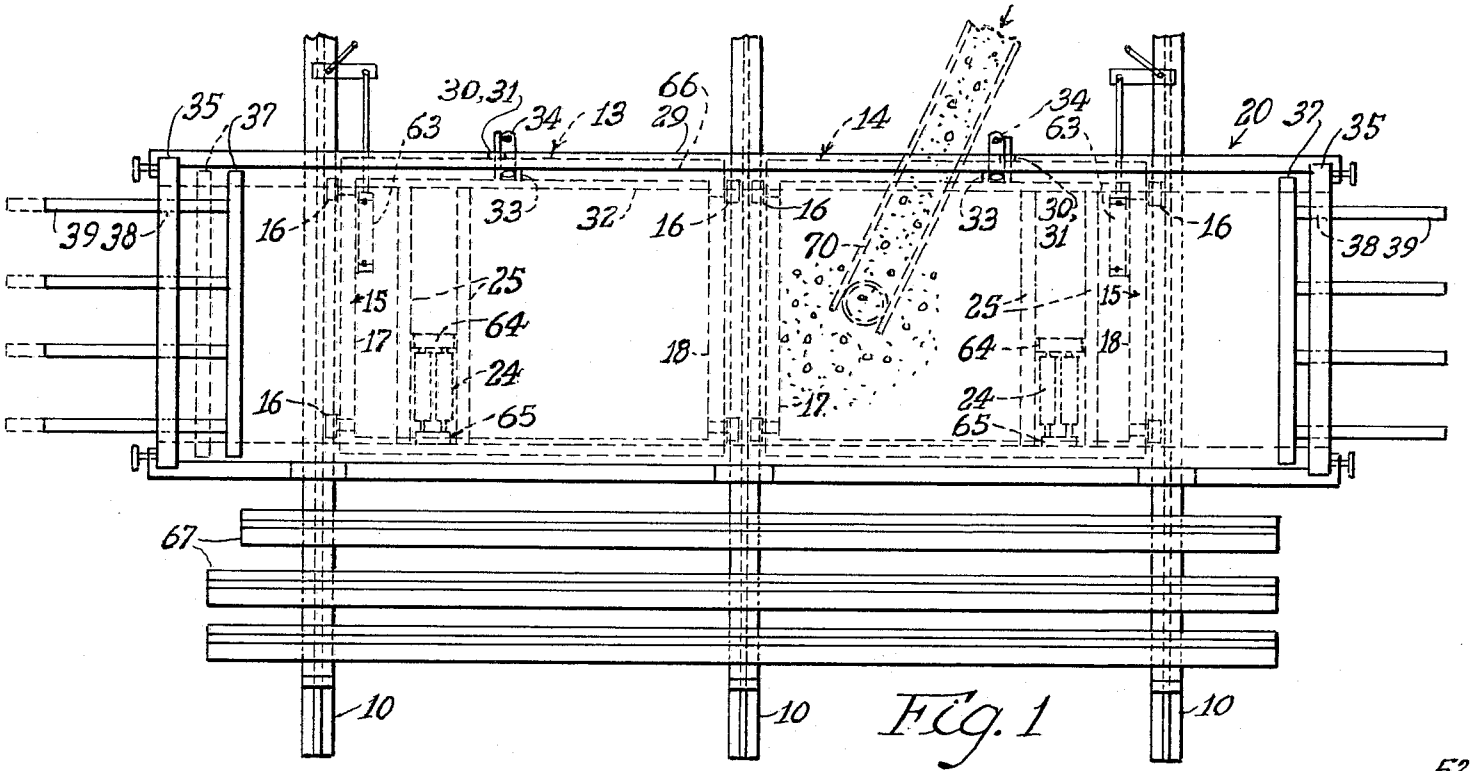
FIG. 1 is a general plan view of the apparatus.

Referring now in detail to the drawings; the apparatus of the invention embodies as a base, a plurality of parallel, flanged beams 10.

Figures 6, 7:
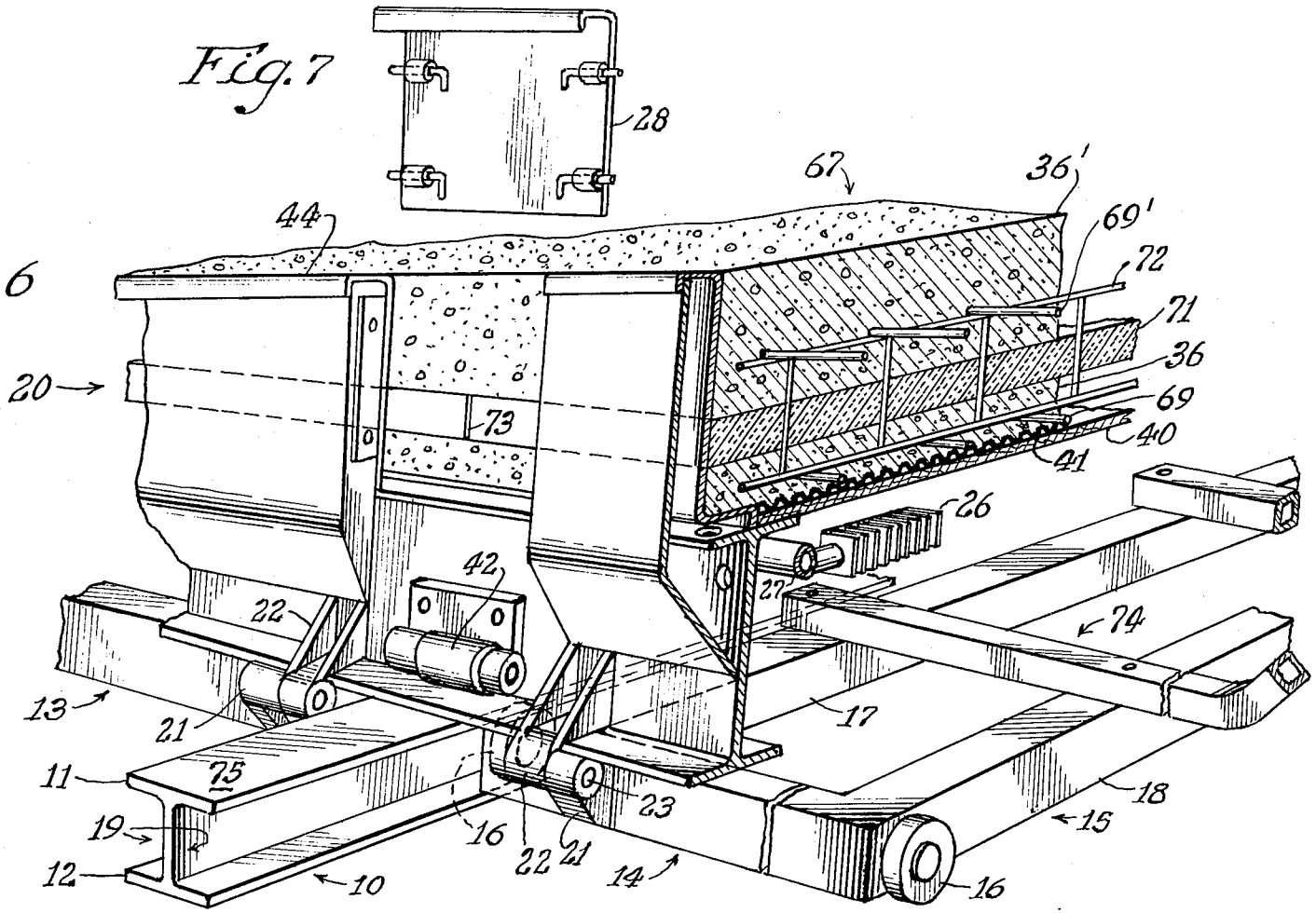
FIG. 6 is a perspective view showing a load bearing roller, the hinging mechanism, heaters, and wheeled carriage and having a section through the mold body and through the insulated panel.
FIG. 7 is a perspective view of the removable mold member that is mounted over the support beam.

Within the runway formed by the top flange 11 and the bottom flange 12 of the flanged beams 10, wheeled carriages 13 and 14 are inserted; for short panels, only one wheeled carriage is needed, each wheeled carriage 13 and 14 is made up of a frame 15 and wheels 16 mounted on the sides 17 and 18 of each frame, the wheels 16 ride on flanges 12 and are contained within the runways 19 formed by such flanges;

The mold 20 is connected to the wheeled carriages 13 and 14, by hinges 21, mounted on the front of the wheeled carriages 13 and 14, and by a plurality of hinge brackets 22, mounted on the front of the mold body 20; when connected by hinge pins 23, the wheeled carriages 13 and 14 and the mold body 20 are thereby hingedly connected as is best shown in drawing FIG. 6;

Hingedly mounted at 64, within the frame 15 of each wheeled carriage 13 and 14 are hydraulic jacks 24 hingedly connected to reinforcing members 25 mounted under the mold 20;

Attached to the bottom of the mold 20 are hot water radiators 26 and hot water feed manifolds 27.

Figure 3:
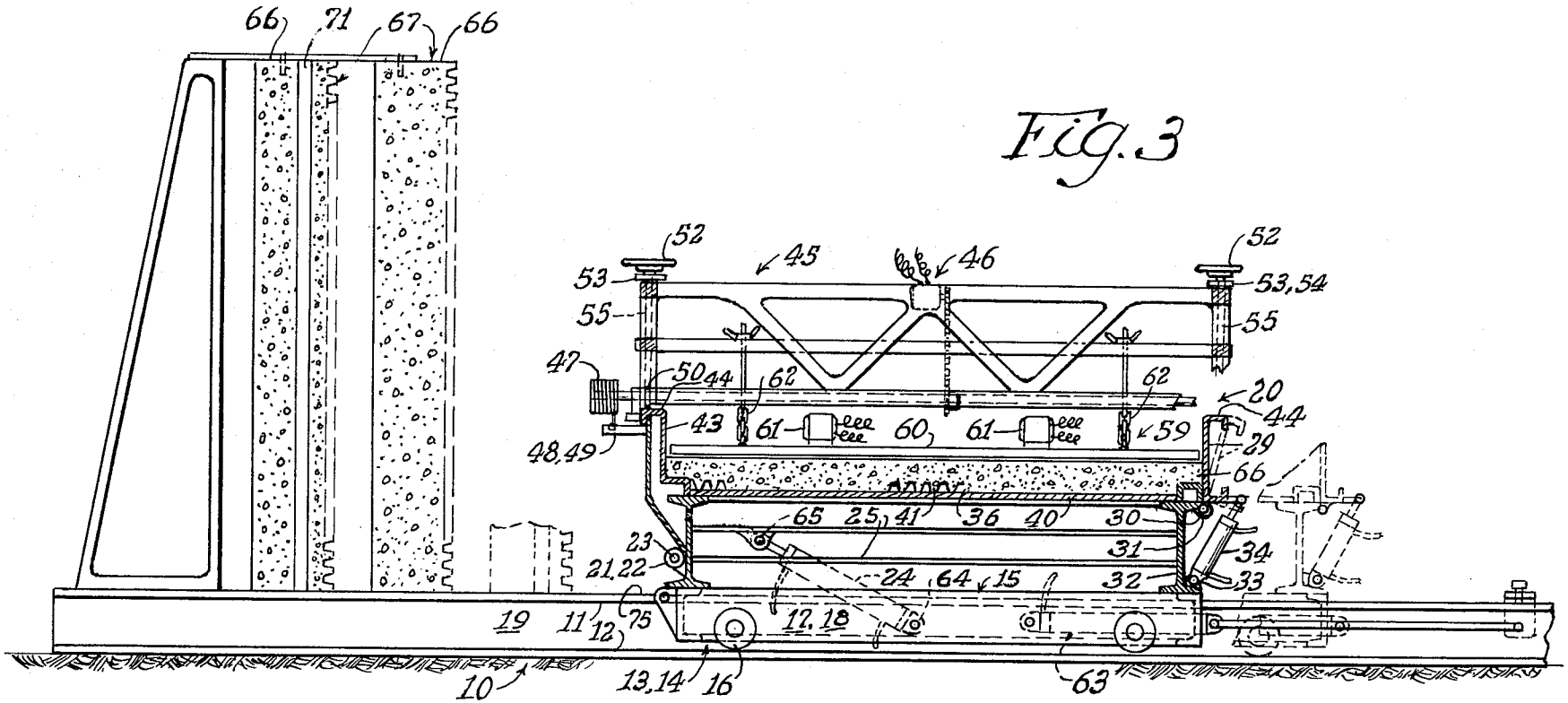
FIG. 3 is an end view with the concrete spreading apparatus in operating position, showing completed panels, and in a shadow view the apparatus moved down the base away from a stacked panel.
Figure 4:
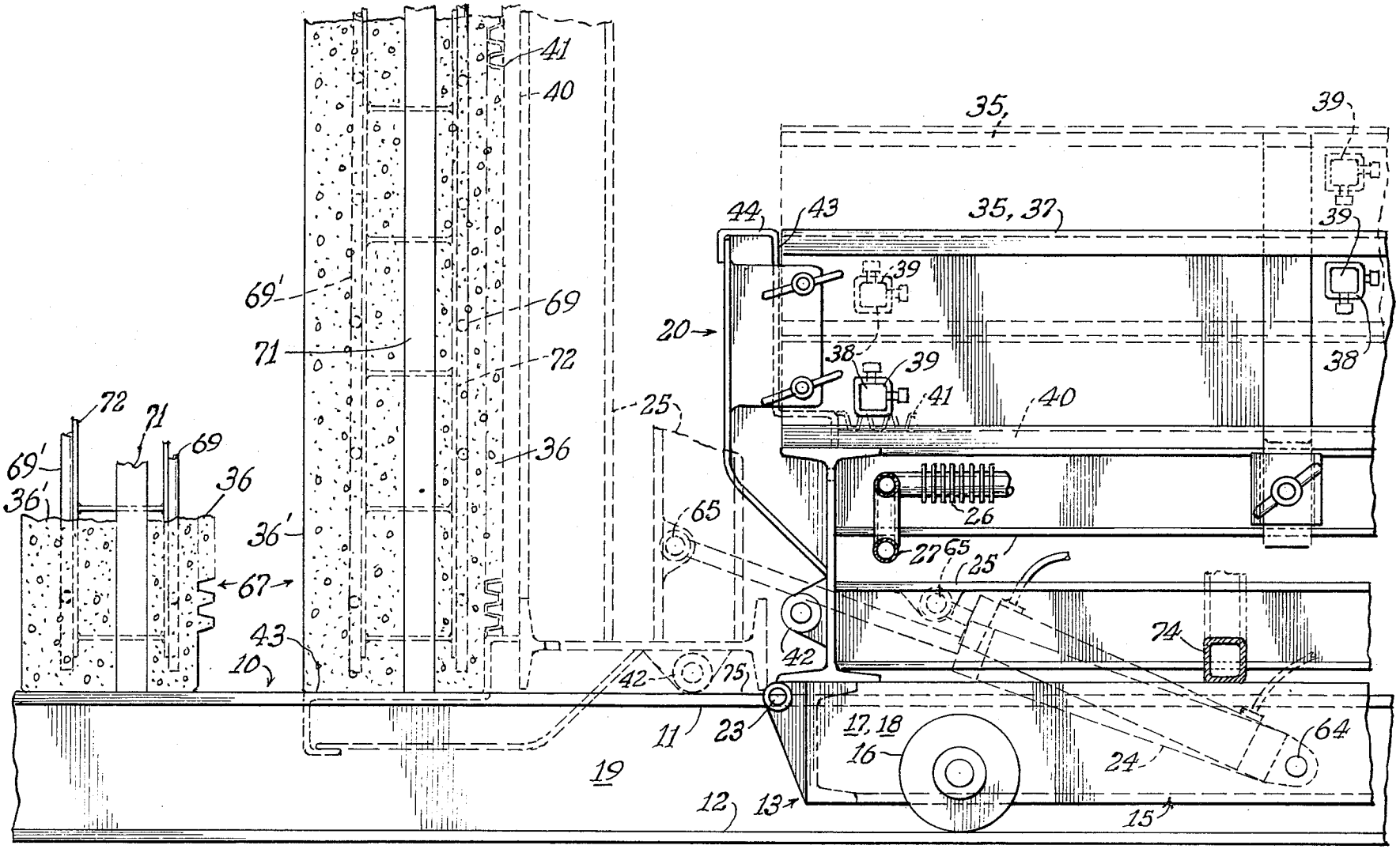
FIG. 4 is a partial end view illustrating the pivoting mechanism.

The side of the mold 20, next to the hinges 21 and the hinge brackets 22, is pierced by removable members 28, the opposite side 29 of the mold 20 has hinges 30, cooperating with hinged bracket 31 of beam 32 of mold 20; hingedly mounted at 33 of beam 32 is a hydraulic cylinder 34, this is best shown in drawing FIG. 3;

The ends 35 of the mold 20 are removable as is best shown in drawing FIG. 4. The length of a panel 67 to be cast can be varied by moving the adjustable end pieces 37, in their slots 38, by means of the adjustment bars 39.

The bottom of the mold 20 has a permanent floor 40 and a removable pattern impressing plate 41 mounted thereon.

Mounted on the mold 20, immediately above each of the support beams 10, are load bearing rollers 42; these load bearing rollers 42 extend outwardly of the side of the mold 20, and are positioned between the hinges 21; the outer faces of the load bearing rollers 42 are located perpendicular to a line extended from the inner edge 43 of the mold 20.

Mounted on the top rails 44, of the mold is a height adjustable concrete spreading, impacting and finishing apparatus 45, hereinafter called the concrete spreading apparatus. This apparatus is comprised of the drive mechanism 46 which comprises the drum 47, the cable 48 and its attachment 49. The whole apparatus is mounted on wheels 50 and is best shown in drawing FIG. 8.

The height adjustment mechanism 51, comprises adjustment wheels 52, and sprockets 53, chains 54 and screws 55, the spreading mechanism 56, comprises auger 57, striker plate 58, and vibrating screed 59. The vibrating screed 59 is comprised of float 60, and vibratory motor 61 and is flexibly connected to the concrete spreading apparatus 45 by chains 62.

Fixedly mounted to the frame 15 of each wheeled carriage 13 and 14 are hydraulic cylinders 63.

In setting up the apparatus, one or a group of bases, comprised of flanged beams laid parallel to each other, 10 are prepared on a job site. The number and location of bases is determined by the size of the construction job and the location where panels will be needed.

Figure 2:
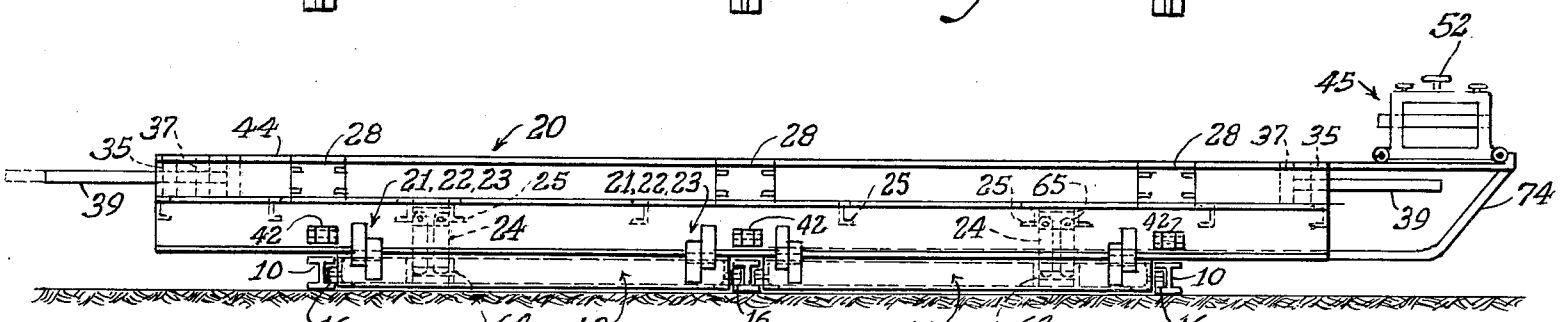
FIG. 2 is a general elevational view of the apparatus.

One wheeled carriage 13 is inserted into position with wheels 16 riding within the flanges 11 and 12 of two of the parallel beams 10, the wheels 16 of the other wheeled carriage 14 are similarly inserted within the flanges 11 and 12 of base beams 10, as is shown in drawing FIG. 1. The wheeled carriages 13 and 14 are thereby free to move back and forth within the area defined by the parallel base beams 10;

The mold 20 is then placed on the wheeled carriages 13 and 14, and hinge pins 23, are placed through the hinge brackets 22, on the mold 20, and the hinges 21 on the wheeled carriages 13 and 14, tying the mold and the carriages together as can be best seen in drawing FIGS. 1, 2, and 6.

Figure 5:
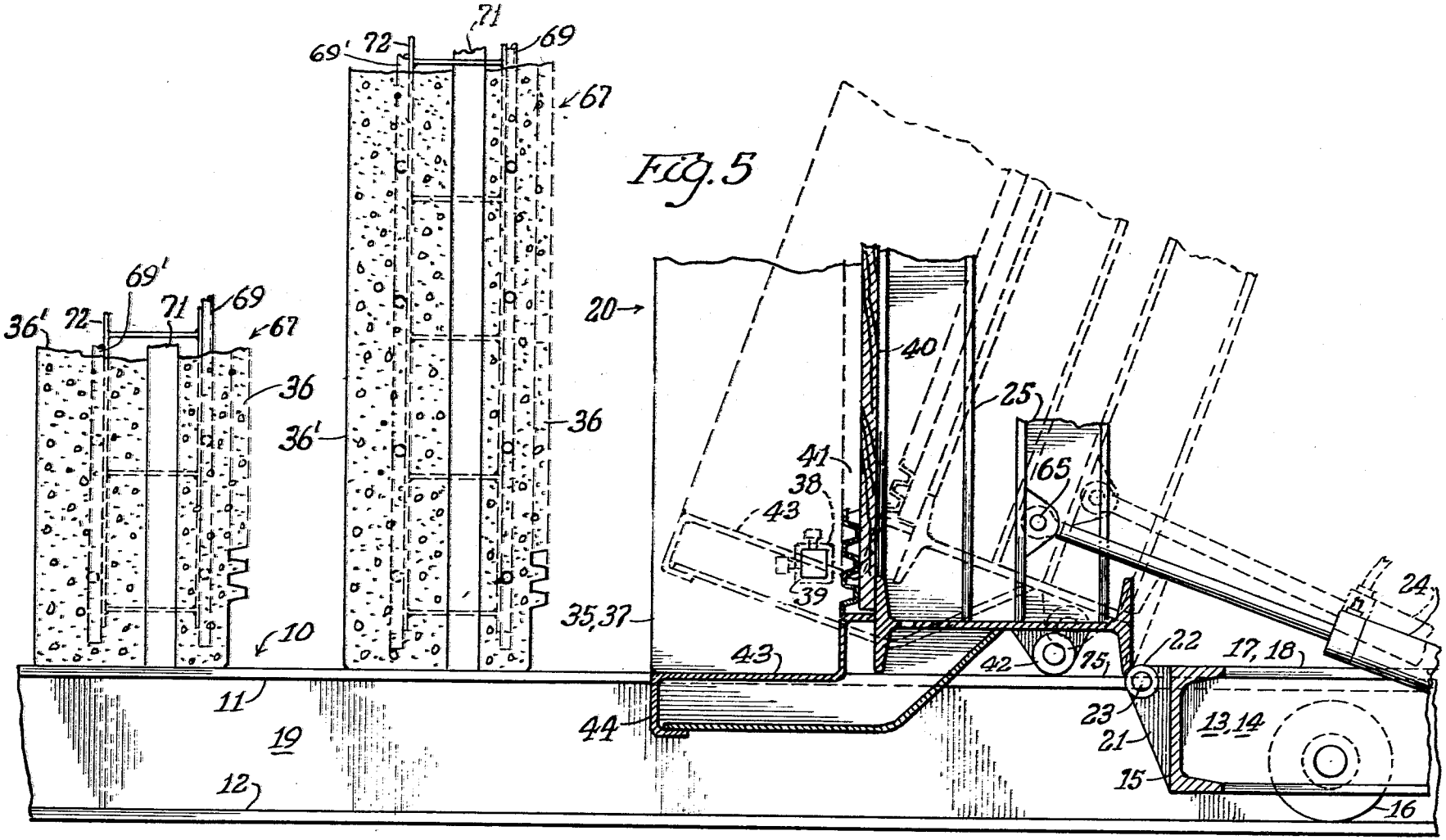
FIG. 5 is a partial end view showing the mold retracted from the standing panel and in shadow the mold being returned to a horizontal position.

The mold 20 is then tilted up along an axis through the hinge pin 23 and the hydraulic jacks 24 mounted on each of the wheeled carriages 13 and 14, are then connected to the mold 20 by hinge pins 65 as can best be seen in drawing FIG. 5.

The concrete spreading apparatus 45 is mounted on the top rails 44 of the mold 20 and the drum 47 and cable 48 is attached at 49.

Power from an external source is connected to the concrete spreading apparatus 45.

An external heat source, as for example, from a low pressure hot water heater, is connected to the hot water feed manifold 27 and radiators 26.

The mold 20 while in a horizontal position is adjusted for length of slab 36 to be cast by setting adjustable end pieces 37 and bars 39 by sliding them back or forth in slots 38 as can be seen in drawing FIG. 1.

A pattern impressing surface 41, the mirror image of what is desired on the completed concrete panel, can then be inserted and fastened to the bottom 40 of the mold 20.

The apparatus is then set to be operated. In operation all concrete contacting parts of the mold are wetted down with a concrete releasing agent, such as kerosene or a light oil, which is old in the art; the concrete spreading apparatus 45 is moved to the end of the mold 35, and is adjusted for depth of striking plate 58 within the mold; the bottom surface of the mold 40 is then heated to 150° F to 250° F; this can be done by circulating hot water from a low pressure hot water boiler through manifolds 27 and through radiators 26; this can be also done with electric resistance heating.

Figure 8:
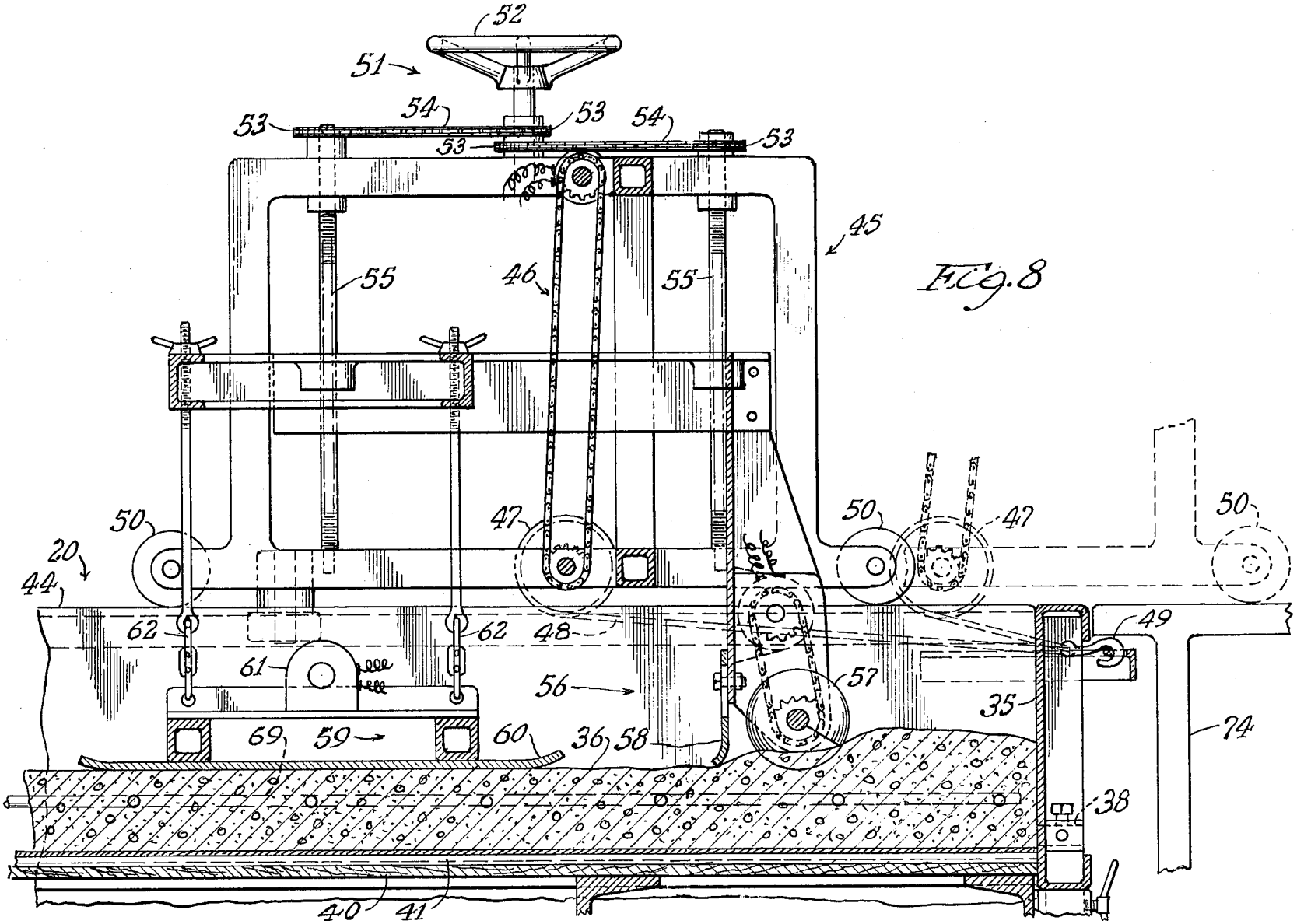
FIG. 8 is a sectional view of the concrete pouring unit taken on line 8—8 of FIG. 9.
Figure 9:
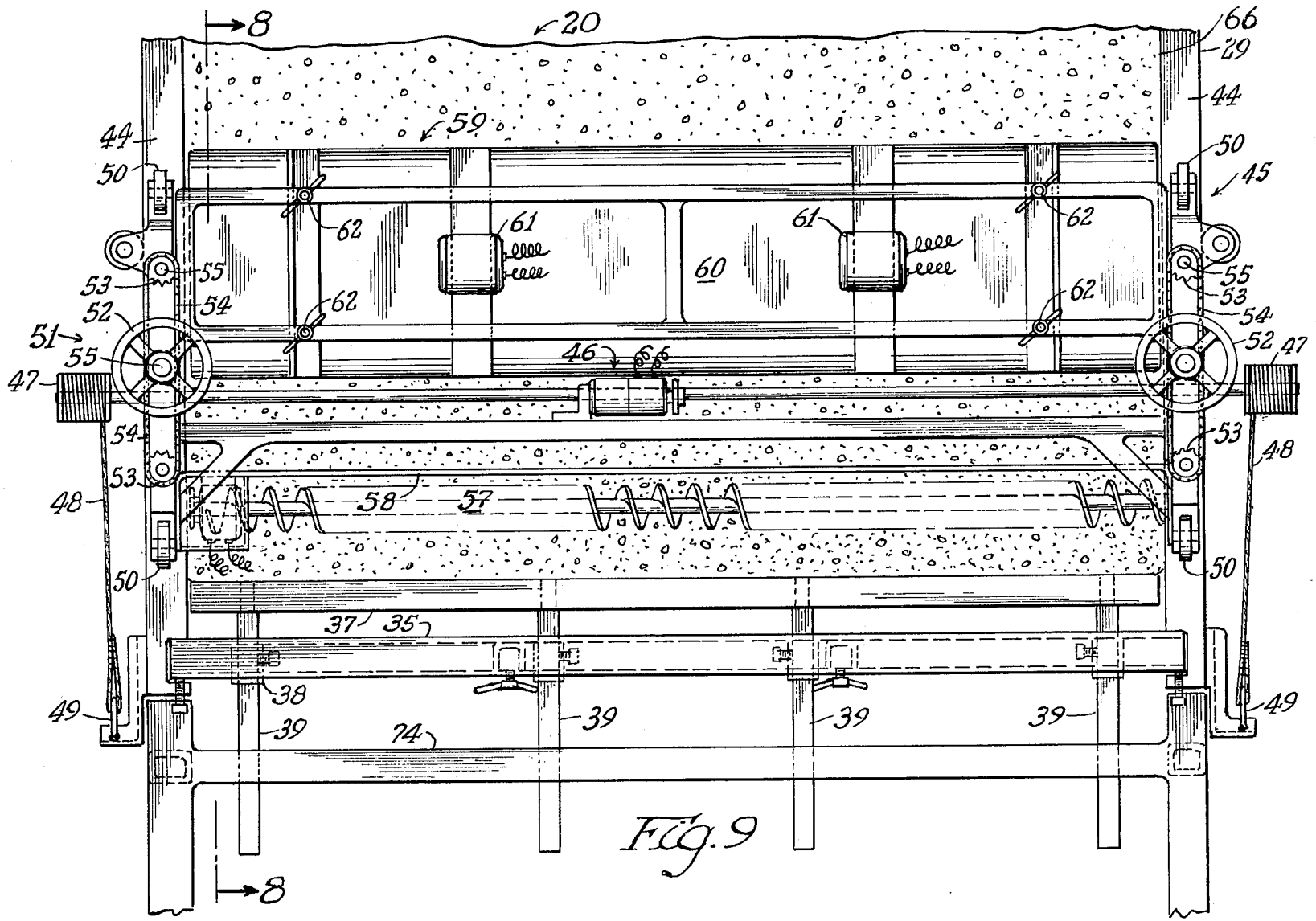
FIG. 9 is a plan view of the concrete pouring unit.

A panel 67 comprising slabs 36 and 36' of reinforced concrete with a layer of insulation 71 sandwiched therein is formed in the mold by:

First, laying within the mold, concrete reinforcing steel 69;

Second, the concrete spreading apparatus 45 as is shown in section, in drawing FIG. 8 is then actuated and concrete is poured 70, as shown in drawing FIG. 1 into the mold 20 at the face of the spreading mechanism 56 in front of auger 57; the concrete spreading apparatus 45 is pulled across the length of the mold 20 by the drum 47 and cable 48; the concrete spreading apparatus 45 rides along the top rails 44 of the mold 20 on its wheels 50; auger 57 and striker plate 58, extending into the mold 20, spread the concrete; pulled behind the spreading mechanism 56 is the vibrating screed 59; the screed 59 with its vibrating float 60 provides a smooth finish on the concrete surface it contacts and forces the stiff concrete through reinforcing steel 69 and into close and intimate contact with the pattern impressing surface 41 of the mold 20;

Third, upon completion of the first slab 36 of concrete, the concrete spreading apparatus 45 is returned to its starting position and the depth of the striker plate 58 within the mold 20, is raised to the desired thickness of the finished panel by means of adjustment wheels 52, sprockets 53, chains 54, and screws 55 this can best be seen in drawing FIG. 8.

Fourth, insulation board 71 is placed into the mold 20 on top of the first slab 36 of concrete; shear connectors 72 are forced between the interstices 73 of the insulation board 71, through still the soft concrete slab 36 below, through to the reinforcing steel 69 in the slab 36;

The size of the shear connector 72 is chosen so that the shear connector 72 stands above the surface of the insulation board 71; upon completion of the second slab 36' these shear connectors 72 tie the two concrete slabs 36 and 36' together with the insulation board 71 sandwiched between.

Fifth, further reinforcing steel 69' is laid upon the shear connectors 72 standing above the insulation board 71, as shown in drawing FIG. 6, and further concrete is poured 70 into the mold 20; the concrete spreading apparatus 45, having been raised above the surface of the insulating panel by height adjustment mechanism 51 to the height determined by the required finished thickness of the panel 67, is actuated and run across the top rails 44 of the mold 20 spreading and compacting the concrete as was done in making the first concrete slab 36. A section through a completed panel 67 is shown in drawing FIGS. 4, 5, and 6.

To remove the panel 67 the concrete spreading apparatus 45 is then run off the mold 20 on to holding device 74, and the concrete is allowed to cure until it reaches 500 pounds per square inch compressive strength.

After the panel 67 has reached this strength, removable members 28 are removed as shown in drawing FIGS. 6 and 7.

The hydraulic mechanism represented by hydraulic jacks 24 is actuated and the mold 20 together with its included insulated panel 67 is pivoted about a longitudinal axis running through hinge pins 23 from a horizontal position to a vertical position as is shown in drawing FIG. 4.

Slightly before the mold 20 reaches the vertical position, load bearing rollers 42 contact the base beams 10, as the panel 67, held within and supported by the mold 20 approaches vertical, the load represented by the panel 67 and mold 20 is supported by the wheels 16 of the wheeled carriages 13 and 14, and by the bottom flanges 12 of the base beams 10; at the instant the weight is borne by the load bearing rollers 42, the moment caused by the swinging weight of the mold and panel is resisted by wheels 16 of the wheeled carriages 13 and 14, against the top flanges 11 of the base beams 10.

When the mold 20 has reached the vertical position, the completed panel 67 is resting directly upon the upper surface 75 of the base beams 10.

Hydraulic cylinder 34 is actuated, and the hinged side 29 of the mold 20, is thereby pulled away from the top 66 of the now free standing concrete panel 67.

Hydraulic cylinders 63 mounted on the frame 15 of the wheeled carriages 13 and 14 are actuated pulling the mold away from the now vertically free standing insulated panel 67, as is shown in drawing FIG. 3, the mold 20 then being supported by load bearing rollers 42 and by the wheels 16 on the wheeled carriages 13 and 14.

After the panel 67 has been removed, the mold 20 is pulled far enough away from the panel 67 so that the mold may be lowered to a horizontal position and removable members 28 can be replaced and the mold 20 can be filled again and the cycle repeated at least twice and as many as four times per day; as the mold 20 is stripped from the panel 67, the mold is moved approximately two panel 67 thicknesses along the base beams 10. The pivoting of the mold 20 back to the horizontal is shown in drawing FIG. 4.

Optionally, panels may be cast without the layer of insulation 71 as shown in FIG. 3 thereby making a solid concrete panel.

I claim:

1. A concrete panel forming apparatus for use on a concrete panel is cast in a mold, comprising:

a base;

a carriage mounted on such base; and movable back and forth thereon;

a mold supported by such carriage and hingedly attached thereto, adapted to pivot longitudinally about such hinged connection from a horizontal to a vertical position with respect to such carriage;

means for mechanically spreading concrete into the mold while such mold is in a horizontal position upon such carriage;

means for pivoting such mold longitudinally from a horizontal position to a vertical position;

means for removing a concrete panel formed within the mold;

means for moving the mold along the base.

2. Reinforced, non-composite, insulated concrete panel forming apparatus of the type in which a concrete panel is cast in a mold on a job site comprising:

a base formed of at least two parallel flanged beams, each of such beams being flanged at their top and bottom;

a wheeled carriage, having front wheels and rear wheels, such wheeled carriage being transversely disposed between such flanged beams;

the wheels of such carriage riding on the flanges of the flanged beams, whereby such carriage is movable within the area defined by such beams;

a mold having, two sides, two ends and a bottom, such mold being hingedly attached on one side to the wheeled carriage;

means to pivot the mold longitudinally relative to the wheeled carriage, around the hinged connection from a horizontal position to a vertical position;

at least one removable mold member piercing the side of the mold above the mold's hinged attachment to the wheeled carriage;

at least one load bearing roller, such load bearing roller being mounted on the same side of the mold as are the hinges connecting the mold and the wheeled carriage;

the outer surface of such load bearing roller being tangent to the extension of an imaginary plane extended parallel to the inner side surface of the mold, immediately above the load bearing roller;

whereby as the mold is pivoted relative to the wheeled carriage and the load is transferred toward the hinges, the load bearing roller contacts the upper surface of the parallel flanged beams as the mold approaches the vertical, the weight of the mold being supported by the load bearing roller and the front wheels of the wheeled carriage.

3. Apparatus as claimed in claim 2 where the pivoting means comprises:

at least one hydraulic cylinder hingedly attached to the bottom of the mold and hingedly attached to the wheeled carriage.

4. Apparatus as claimed in claim 2 further comprising:

a wheeled carriage mounted on top of the sides of the mold and movable along the length of the mold;

a concrete spreading device mounted on such wheeled carriage, disposed to travel lengthwise within such mold; and means for varying the depth of the concrete spreading device within the mold.

5. Apparatus as claimed in claim 4 where the concrete spreading device comprises:

at least one auger whose axis of rotation is perpendicular to the lengthwise axis of the mold;

a striker plate whose direction of travel is parallel to the lengthwise axis of the mold; and a vibrating screed flexibly attached to the wheeled carriage.

6. Apparatus as claimed in claim 2 wherein:

the mold has detachably mounted therein a pattern impressing plate; and heaters are mounted on the non concrete contacting surface of the mold.

7. Apparatus as claimed in claim 2 wherein:

the side of the mold away from the hinged connection to the wheeled carriage is hinged; and at least one hydraulic cylinder is attached to the mold and to the hinged side, whereby when the cylinder is energized, the hinged side of the mold is pulled away from a concrete panel cast within the mold.

* * * * *